US009557055B2

(12) United States Patent
Hagi et al.

(10) Patent No.: US 9,557,055 B2
(45) Date of Patent: Jan. 31, 2017

(54) COMBUSTION PLATE

(75) Inventors: Satoshi Hagi, Nagoya (JP); Hisatoshi Ito, Nagoya (JP); Hideo Okamoto, Nagoya (JP); Yoshihiko Takasu, Nagoya (JP)

(73) Assignee: RINNAI CORPORATION, Aichi (JP)

( * ) Notice: Subject to any disclaimer, the term of this patent is extended or adjusted under 35 U.S.C. 154(b) by 948 days.

(21) Appl. No.: 13/504,298

(22) PCT Filed: Oct. 18, 2010

(86) PCT No.: PCT/JP2010/006155

§ 371 (c)(1),
(2), (4) Date: Apr. 26, 2012

(87) PCT Pub. No.: WO2011/055494

PCT Pub. Date: May 12, 2011

(65) Prior Publication Data

US 2012/0214111 A1 Aug. 23, 2012

(30) Foreign Application Priority Data

Nov. 9, 2009 (JP) ..... 2009-255778

(51) Int. Cl.
*F23D 14/62* (2006.01)
*F23D 14/58* (2006.01)
(Continued)

(52) U.S. Cl.
CPC ..... *F23D 14/58* (2013.01); *F23D 14/34* (2013.01); *F23D 14/74* (2013.01); *F23D 2203/1023* (2013.01); *F23D 2210/00* (2013.01)

(58) Field of Classification Search
CPC ..... F23D 14/14; F23D 14/02; F23D 14/145; F23D 2203/102; F23D 11/406; F23D 14/12; F23D 14/125; F23D 11/404; F24C 15/24; F27D 2099/0045; F27D 99/0035; F27D 99/0033
(Continued)

(56) References Cited

U.S. PATENT DOCUMENTS 3,251,396 A * 5/1966 Nitsche ..... 431/328
3,558,252 A * 1/1971 Roca ..... 431/328
(Continued)

FOREIGN PATENT DOCUMENTS

JP 51-46265 A 4/1976
JP 52-137728 A 11/1977
(Continued)

OTHER PUBLICATIONS

"Influence of Fuel Injection Strategy on Flame Flashback in Swirl Burners", Technische Universitat Munchen, https://www.td.mw.tum.de/en/research/research-areas/projektbeschreibungen/influence-of-fuel-injection-strategy-on-flame-flashback-in-swirl-burners/ (accessed Aug. 31, 2015).*
(Continued)

*Primary Examiner* — Jason Lau
(74) *Attorney, Agent, or Firm* — Cermak Nakajima & McGowan LLP; Tomoko Nakajima

(57) ABSTRACT

There is provided a combustion plate in which the combustion resonant sounds and instability at the time of high-load combustion can be resolved and in which a large opening ratio of the flame holes can be secured. Flame holes of an equal diameter are formed evenly over an entire surface of a combustion region of a plate main body in such a positional relationship that adjoining three flame holes form an equilateral triangle. Provided that a flame hole group which is made up of six flame holes disposed in a positional relationship to form an equilateral hexagon and one flame
(Continued)

hole in the center of the equilateral hexagon is defined as a unit flame hole group when disposed adjacent to another flame hole group across a large equilateral hexagon enclosing the equilateral hexagon, there is formed in the surface of the plate main body a bottomed hole.

6 Claims, 13 Drawing Sheets

(51) Int. Cl.
*F23D 14/34* (2006.01)
*F23D 14/74* (2006.01)

(58) Field of Classification Search
USPC ..... 126/92 R; 431/329, 328
See application file for complete search history.

(56) References Cited

U.S. PATENT DOCUMENTS 3,683,058 A * 8/1972 Partiot et al. ..... 264/156
3,825,403 A * 7/1974 Gottschall ..... 431/328
4,063,873 A * 12/1977 Naito ..... 431/328
4,083,355 A * 4/1978 Schwank ..... 126/39 J
4,504,218 A * 3/1985 Mihara et al. ..... 431/326
4,569,657 A * 2/1986 Laspeyres ..... 431/326
5,571,009 A * 11/1996 Stålhane et al. ..... 431/328
6,575,736 B1 * 6/2003 Aust et al. ..... 431/328
6,619,280 B1 * 9/2003 Zhou et al. ..... 126/39 R
D676,707 S * 2/2013 Okamoto et al. ..... D7/407
2001/0010896 A1 * 8/2001 Nagayama et al. ..... 431/10
2003/0138749 A1 * 7/2003 Clifford et al. ..... 431/100
2005/0069830 A1 * 3/2005 Aust ..... F23D 14/14 431/328
2009/0032012 A1 * 2/2009 von Herrmann et al. ... 126/39 J

FOREIGN PATENT DOCUMENTS

JP 56-162426 A 12/1981
JP 57-129313 A 8/1982
JP 57-129314 A 8/1982
JP 60-082709 A 5/1985
JP 62-192019 A 8/1987
JP 06-147435 A 5/1994
JP 7-59966 B2 6/1995
JP 2003-520935 A 7/2003
JP 2007-333223 A 12/2007
JP 2009-068788 A 4/2009

OTHER PUBLICATIONS

International Search Report for PCT Patent App. No. PCT/JP2010/006155 (Nov. 30, 2010).
Office Action from Japanese Patent App. No. 2009-255778 (Sep. 10, 2013).

* cited by examiner

COMBUSTION PLATE

This application is a national phase entry under 35 U.S.C. §371 of PCT Patent Application No. PCT/JP2010/006155, filed on Oct. 18, 2010, which claims priority under 35 U.S.C. §119 to Japanese Patent Application No. 2009-255778, filed Nov. 9, 2009, both of which are incorporated by reference.

TECHNICAL FIELD

The present invention relates to a combustion plate to be used in a totally aerated combustion burner (or a fully primary aerated burner) which is equipped in a heat source apparatus mainly for supplying hot water or for heating space, and relates to the combustion plate which is made by forming, in a plate main body of ceramic make, a multiplicity of flame holes for ejecting premixed gas.

BACKGROUND ART

As this kind of combustion plate, there is conventionally known in Patent Document 1 a combustion plate in which flame holes are formed over the entire surface of the combustion plate such that three kinds of large, middle, and small flame holes are positioned so that: various kinds of flame holes are distributed in lattice shape; and that the large hole is positioned in the center of the four adjoining small flame holes and is also positioned in the center of the adjoining four middle flame holes; that each of the small flame holes is formed so as to be positioned in the middle of the adjoining two middle flame holes; and that on the surface of a plate main body there is formed a bottomed hole which is coaxial with each of the large flame holes and partly includes each of the small flame holes that are present in the circumference of the large flame hole. It is said therein that, according to the above-mentioned arrangement, the combustion resonant sounds and instability at the time of high-load combustion that are likely to occur in an arrangement in which the flame holes are all made to be of the same diameter, can be dissolved.

By the way, in the Patent Document 1 a description is made of a combustion plate, in the combustion plate of which the diameter of the large flame hole is made to be 1.9 mm, the diameter of the middle flame hole is made to be 1.3 mm, the diameter of the small flame hole is made to be 1.0 mm, and also four small flame holes are disposed on the circumference of 2.4 mm in diameter that is coaxial with the large flame hole, and four middle flame holes are disposed at an equal distance to one another, in a phase deviated from the small flame holes by 45 degrees, on the circumference of 3.4 mm in diameter that is coaxial with the large flame hole.

However, in the art described in the Patent Document 1, due to the fact that flame holes of different diameters are disposed in lattice shape, the opening ratio (the ratio of total area of the entire flame holes to the total area of the combustion region of the plate main body) becomes comparatively small. In the example described above, the opening ratio was about 26%. Therefore, there was a disadvantage in that a passage resistance through the combustion plate becomes large, with a resultant increased load on the fan to supply primary air to the burner increase, whereby the fan noises become large.

PRIOR ART DOCUMENT

Patent Document 1: TOKKOHEI 7-59966 (Examined Patent Publication No. 1995-59966)

SUMMARY

Problems that the Invention is to Solve

In view of the above points, this invention has a problem of providing a combustion plate which is capable of solving the combustion resonant sounds and instability at the time of high-load combustion and which is also capable of securing a larger opening degree of the flame holes.

Means of Solving the Problems

In order to solve the above-mentioned problems, according to the invention, there is provided a combustion plate for a totally aerated combustion burner in which a multiplicity of flame holes for ejecting a premixed gas are formed in a plate main body of ceramic make, wherein the flame holes of an equal diameter are evenly formed over an entire surface of a combustion region of the plate main body in such a positional relationship that adjoining three flame holes form an equilateral triangle, and wherein, provided that a flame hole group which is made up of six flame holes disposed in a positional relationship to form an equilateral hexagon and one flame hole in the center thereof is defined as a unit flame hole group when disposed adjacent to another flame hole group across a large equilateral hexagon which is made up of a flame hole at each of the corner portions and a flame hole in a middle of each of the sides of the large equilateral hexagon, a bottomed hole (or a recess) is formed in the surface of the plate main body in a manner: to be coaxial with the flame hole in the center of each of the unit flame hole groups; to be smaller than a diameter of a circle circumscribing the six flame holes that are in such a positional relationship as to form the equilateral hexagon; and to be larger than a diameter of a circle inscribing the six flame holes, whereby the premixed gas ejected from the six flame holes has a velocity component toward a center of the bottomed hole.

According to the invention, by disposing the flame holes of the same diameter in such a positional relationship that the adjoining three flame holes form an equilateral triangle, the flame holes can be disposed in as much densest manner as possible within a limit in which the combustion plate can be manufactured. As a result, the opening ratio of the flame holes can be largely increased as compared with the conventional examples, so that the resistance to pass through the combustion plate can be reduced. The load on the fan to supply the primary air to the burner can thus be decreased and the fan noise can be reduced.

Further, the premixed gas to be ejected from the six flame holes that are in the positional relationship to form an equilateral hexagon of each of the unit flame holes, has a velocity component toward the center of the bottomed hole. There can thus be obtained an effect of reducing the ejection velocity of the premixed gas in the direction of the normal to the surface of the combustion plate. As a result, the shape of the aggregated flames to be formed by the combustion of the premixed gas ejected from the bottomed hole of the unit flame hole group becomes a mountain shape without a steep rise. As a consequence, there can be obtained an effect of maintaining a stable flame to restrict the flame lifting off at the time of high-load combustion. Therefore, despite the fact that all the flame holes are made into the same diameter, there can be secured combustion stability at the time of high-load combustion.

In addition, if each of the aggregated flames to be formed by the combustion of the premixed gas ejected from the bottomed holes of each of the unit flame holes lies next to one another, the aggregated flames get resonant with one another to thereby generate large combustion resonant sounds. In this invention, on the other hand, since there exist large equilateral hexagonal flame holes among each of the unit flame hole groups, there will be formed flames that are separated from the aggregated flames as a result of combustion of the premixed gas ejected from these flame holes. Resonance among the aggregated flames will thus be restricted, whereby the combustion resonant sounds will be reduced.

Here, if the bottom surface of the bottomed hole is formed so as to become deeper toward the center thereof, and/or if the bottomed hole is formed so as to become smaller in diameter toward the bottom surface, the premixed gas to be ejected from the six flame holes in such a positional relationship as to form equilateral hexagon of each of the unit flame holes advantageously becomes easy to have the velocity component in the central direction of the bottomed hole.

Further, if the depth of the lowermost portion of the peripheral surface of the bottomed hole becomes smaller than 1 mm, the aggregated flames are less likely to be formed, whereby the combustion becomes unstable. On the other hand, if the depth of the lowermost portion of the peripheral surface of the bottomed hole exceeds 3 mm, the premixed gas to be ejected from the six flame holes that form equilateral hexagon of the unit flame hole group becomes a parallel flow when it comes out of the bottomed hole, whereby an effect of maintaining a stable flame becomes hardly obtainable. Therefore, it is preferable to keep the depth of the lowermost portion in the periphery of the bottomed hole above 1 mm and below 3 mm.

Further, according to this invention, provided that a predetermined diagonal direction of, or an opposing direction of predetermined opposite sides of, the equilateral hexagon to be constituted by six flame holes in the unit flame hole group is defined as a row direction, preferably closure (or closing) is made of at least such partial flame holes out of the twelve flame holes as are positioned on the large equilateral hexagon that encloses each of the unit flame hole groups belonging to a selected row, the selected row being selected at a predetermined distance in a direction perpendicular to the row direction out of the unit flame hole groups arrayed in the row direction. According to this arrangement, there will be generated a circulating flow region in which the premixed gas to be ejected out of the bottomed hole of the unit flame hole group is partially swirled so as to return to the flame hole closed portion, thereby enhancing the effect of maintaining a stable flame. As a result, the combustion stability at the time of high-load combustion can still further be improved.

If the flame holes on the large equilateral hexagon are closed in all of the large equilateral hexagons that enclose the respective unit flame hole groups, there will be generated resonance of the aggregated flames in the entire region of the combustion plate, whereby combustion resonant sounds tend to be easily generated. Against the above, preferably setting is made of the predetermined distance such that, where the row direction is the diagonal direction, at least three non-selected rows are present between each of the selected rows and that, where the row direction is the opposing direction of the opposite sides, at least two non-selected rows are present between each of the selected rows. Then, the generation of resonance among the aggregated flames is limited to a partial region of the combustion plate, whereby the combustion resonant sounds can be reduced.

Preferably, the flame holes to be subjected to closure are the flame holes positioned at each of the corner portions of the large equilateral hexagon. According to this arrangement, there can be obtained an effect similar in degree to the effect in which all of the flame holes that are positioned on the large equilateral hexagons are closed. Further, as compared with the example in which all of the flame holes positioned on the large equilateral hexagons are closed, the opening degree of the flame holes can advantageously be made larger.

PREFERRED EMBODIMENTS FOR CARRYING OUT THE INVENTION

Figure 1:
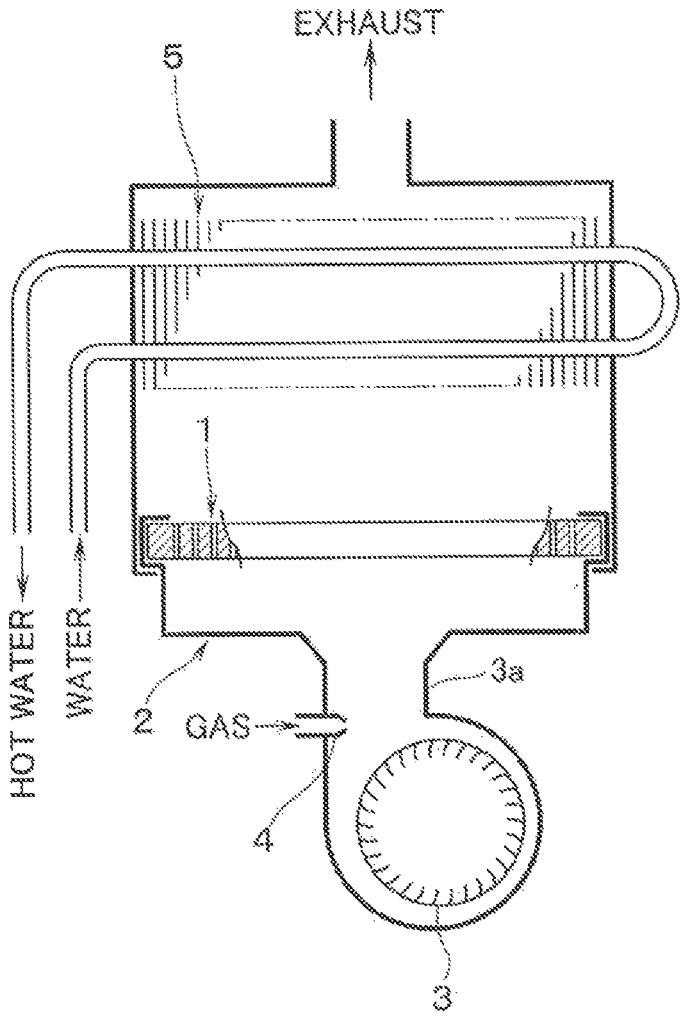
FIG. 1 is a schematic sectional view of a heat source apparatus provided with a totally aerated combustion burner.

FIG. 1 shows a heat source apparatus for the purpose of supplying hot water or of heating space, the apparatus being provided with a totally aerated combustion burner 2 using a combustion plate 1. The burner 2 has a fan 3 connected to the burner 2 via an air duct 3*a*. Further, the air duct 3*a* is provided with a gas nozzle 4 which injects a fuel gas into the air duct 3*a*. Premixed gas of primary air to be supplied by the fan 3 and the fuel gas to be injected from the gas nozzle 4 are ejected via the combustion plate 1 and burnt so as to heat, by the combustion gas, a heat exchanger 5 for supplying hot water or for heating space.

Here, the fan 3 is controlled such that the amount of the primary air becomes larger than a stoichiometric amount of air required for complete combustion of the fuel gas. For that purpose the premixed gas having an excess air ratio (primary air amount/stoichiometric air amount) of larger than 1 is ejected via the combustion plate 1 to thereby perform totally aerated combustion.

Figure 2:
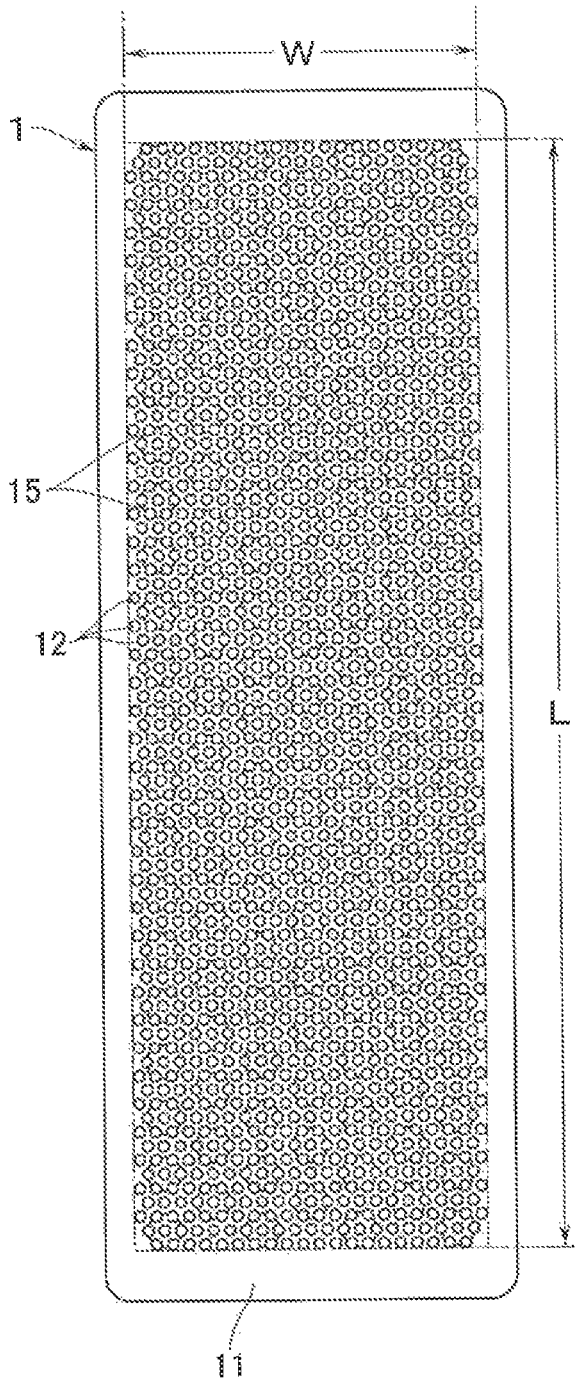
FIG. 2 is a plan view of a combustion plate according to a first embodiment of this invention.

With reference to FIG. 2, the combustion plate 1 is made by forming a multiplicity of flame holes 12, which eject premixed gas, in a plate main body 11 which is made of ceramics and is rectangular in shape as seen in plan view. In this embodiment, flame holes 12 of the same diameter are formed evenly over the entire surface of the combustion region of the plate main body 11 in such a positional relationship that the adjoining three flame holes 12 form an equilateral triangle. In this embodiment the dimension W in the lateral (short) direction and the dimension L in the longitudinal direction of the combustion region are set to be W=50 mm and L=140 mm. The thickness of the plate main body 11 is 13 mm.

It is to be noted here that the diameter of the flame hole 12 exceeding 1.5 mm is likely to cause back fire (flash back) and that the diameter thereof below 0.8 mm is likely to give rise to difficulties in manufacturing of the combustion plate 1. Therefore, it is desirable to set the diameter of the flame hole 12 to 0.8 mm-1.5 mm. In addition, the distance between the centers of the flame holes (i.e., the pitch) shall be set to a value about 1.5 times the diameter of the flame hole 12, the value being the minimum value required to secure the mechanical strength. According to this arrangement, the flame holes 12 can be arranged in the densest manner within a range that is capable of manufacturing. In this embodiment the diameter of the flame hole 12 is set to be 1.25 mm, and the pitch to be 1.9 mm. In this case, the opening ratio of the flame holes 12 is 36%, and this opening ratio is a large increase as compared with that described as an example in the above-mentioned Patent Document 1. As a result, the resistance to pass through the combustion plate 1 is decreased, the load on the fan 3 is reduced, and the fan noises at the time of high-load combustion can be effectively reduced.

Figure 3:
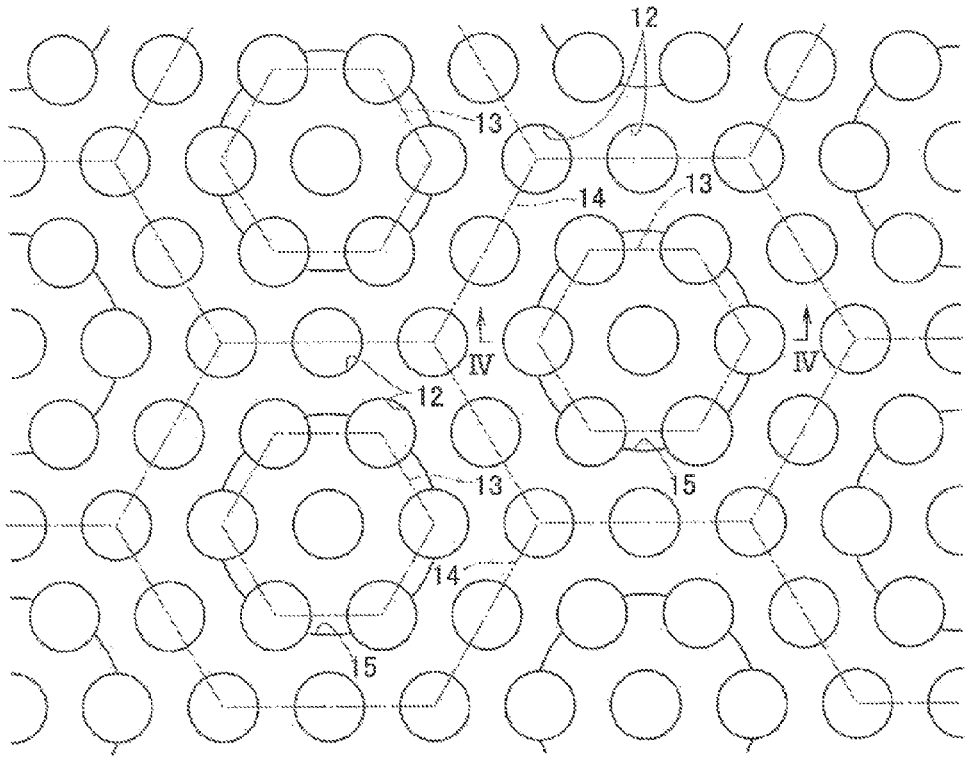
FIG. 3 is an enlarged plan view showing a part of the combustion plate in FIG. 2.
Figure 4:
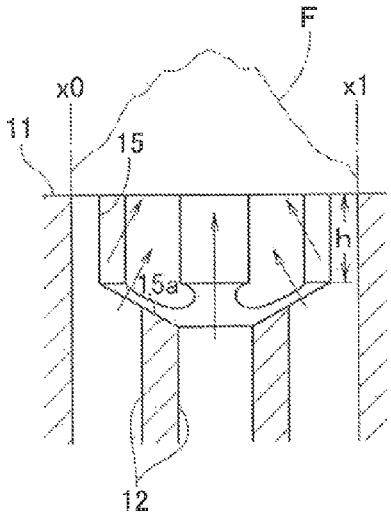
FIG. 4 is a sectional view taken along the line IV-IV in FIG. 3.

Further, as shown in FIG. 3 and FIG. 4, a flame hole group which is made up of six flame holes 12 disposed in a positional relationship to form an equilateral hexagon 13 and one flame hole 12 in the center of the equilateral hexagon 13 is defined as a unit flame hole group when disposed (or when lying) adjacent to another flame hole group across a large equilateral hexagon 14 which is made up of a flame hole 12 at each of the corner portions and a flame hole 12 in the middle of each of the sides of the equilateral hexagon 14. A bottomed hole 15 is formed in the surface of the plate main body 11 in a manner: to be coaxial with the flame hole 12 in the center of each unit flame hole group; to be smaller than the diameter of a circle circumscribing the six flame holes 12 that are in such a positional relationship as to form an equilateral hexagon 13; and to be larger than the diameter of a circle inscribing the six flame holes 12. In this embodiment, the diameter of the bottomed hole 15 is set to be 4 mm, and an arrangement is made that one-half of the inner side of each of the flame holes 12 in the positional relationship to form an equilateral hexagon 13 lies within the bottomed hole 15.

According to this arrangement, the premixed gas to be ejected from each of the flame holes 12 in the positional relationship to form an equilateral hexagon 13 of the unit flame hole group comes to have a velocity component toward the central direction of the bottomed hole 15. Therefore, there can be obtained an effect of reducing the ejecting velocity of the premixed gas in the direction of the normal to the surface of the combustion plate. As a result, the shape of the aggregated flames F formed by the combustion of the premixed gas that is ejected from the bottomed hole 15 of the unit flame hole group becomes a mountain shape without steep rises. There can thus be obtained a flame stabilizing effect to restrict the flame liftoff at the time of high-load combustion. Therefore, despite the fact that the flame holes 12 are all made in the same diameter, there can be secured the combustion stability at the time of high-load combustion.

By the way, if each of the aggregated flames F formed by the combustion of the premixed gas to be ejected from the bottomed hole 15 of each of the unit flame hole groups lies adjacent to one another, large combustion resonant sounds will be generated as a result of resonance of the aggregated flames F. On the other hand, in this embodiment, since there exist the flame holes 12 on the above-mentioned large equilateral hexagon 14 between each of the unit flame hole groups, there will be formed flames that are separated from the aggregated flames F due to the combustion of the premixed gas ejected from the flame holes 12 on the large equilateral hexagon 14. As a result, the resonance among the aggregated flames F will be restricted, and the combustion resonant sounds will be reduced.

In addition, according to this embodiment, the bottom surface of the bottomed hole 15 is formed into a tapered surface 15*a* which becomes gradually deeper toward the center. According to this arrangement, the velocity component, toward the central direction, of the bottomed hole 15 can be more effectively added to the premixed gas that is ejected from each of the flame holes 12 in such a positional relationship as will form equilateral hexagon 13 of the unit flame hole groups.

Figure 5:
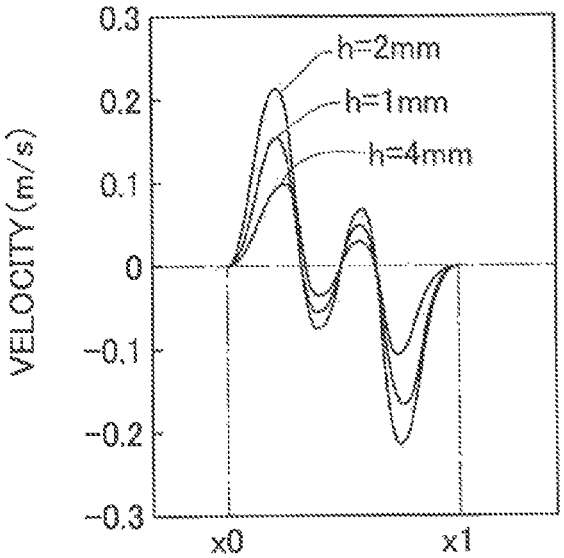
FIG. 5 is a graph showing the velocity component, toward the central direction of a bottomed hole, of the premixed gas ejected from the flame holes of a unit flame hole group.

Further, a simulation was made by using a general-purpose three dimensional thermal fluid analysis program called "FLUENT ver. 6" by ANSYS Company. The velocity components in the central direction of the bottomed hole 15 were studied at a depth of 1 mm when a premixed gas was flown into each of the flame holes 12 at a flow rate of $2.94\times10^{-6}$ $m^3$/sec with respect to the depths h of 1 mm, 2 mm, and 4 mm at the lowermost circumferential portion of the bottomed hole 15. The results are given in FIG. 5. The abscissa of FIG. 5 shows the positions from x0 to x1 in FIG. 4. The velocity on the ordinate is represented on condition that the components toward the central direction to the right in FIG. 4 is plus, and the component toward the central direction to the left in FIG. 4 is minus. The values in the above-mentioned flow rate are equivalent to the values when a premixed gas, the fuel gas of which is methane and air excess ratio is 1.6, is supplied at an input of 12 kW.

As can be seen in FIG. 5, the velocity component in the central direction is the largest when the depth h=2 mm, is slightly smaller when h=1 mm, and is far smaller when h=4 mm. If the depth h is smaller than 1 mm, the aggregated flames are less likely to be formed, and the combustion is likely to become unstable. Therefore, it is desirable to set the depth h to 1 mm or more but below 3 mm. In this embodiment setting was made to h=2 mm.

Figure 6A:
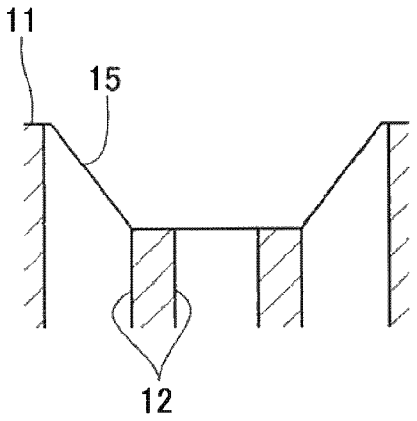
FIGS. 6(*a*)-6(*c*) are sectional views showing modified examples of the bottomed hole.
Figure 6B:
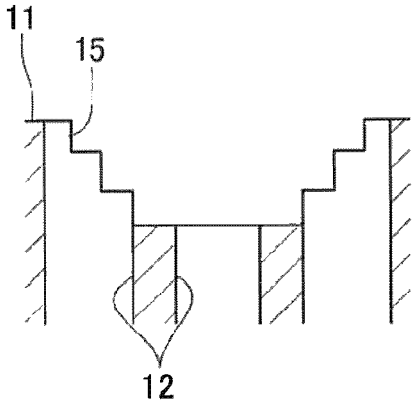
Figure 6C:
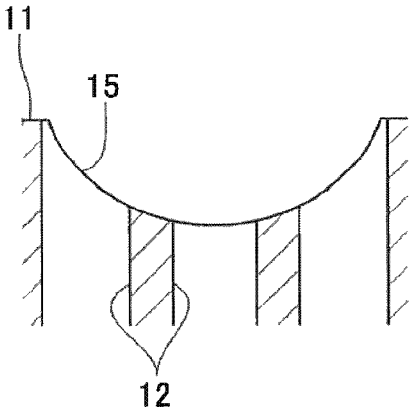

By the way, in this embodiment the bottom surface 15*a* of the bottomed hole 15 is formed into a tapered surface. It is also possible to form the bottomed hole 15 so as to become gradually reduced in diameter toward the bottom surface as shown in FIG. 6(*a*), or the bottomed hole 15 is formed so as to become reduced stepwise in diameter toward the bottom surface as shown in FIG. 6(*b*), or the bottomed hole 15 is formed into a rounded shape so as to become gradually reduced in diameter toward the bottom surface as shown in FIG. 6(*c*), such that the velocity component toward the central direction of the bottomed hole 15 can be easily given to the premixed gas to be ejected from each of the flame holes 12 that form the equilateral hexagon 13 of the unit flame hole group. In addition, the bottomed hole 15 may be formed so as to be reduced in diameter toward the bottom surface and, at the same time, the bottom surface of the bottomed hole 15 may be formed into a tapered surface.

Description will now be made of the second embodiment-the fifth embodiment of the combustion plate 1 as shown in FIG. 7-FIG. 10. The difference of the second embodiment-the fifth embodiment from the above-mentioned first embodiment is as follows, i.e., let the left and right diagonal direction (i.e., the short-side direction of the plate main body 11), as seen in the figure, of the equilateral hexagon that is formed by the six flame holes 12 of the unit flame hole group be defined as a row direction. Then, from among the rows 16 of the unit flame hole groups that are arrayed in the row direction, a plurality of rows are selected in a direction perpendicular to the row direction (i.e., in the longitudinal direction of the plate main body 11), and at least partial (i.e., part of the) flame holes 12 positioned on the large equilateral hexagons 14 enclosing each of the unit flame hole groups belonging to the selected rows are closed (i.e., blocked to passage). The size of the combustion region, the diameter of the flame holes 12, the pitch, the diameter of the bottomed hole 15, and the depth h are the same as those in the first embodiment. In the figures the closed flame holes 12, i.e., the portions that are not actually drilled among the flame holes 12 formed in the first embodiment, are represented by painting them black.

Figure 7:
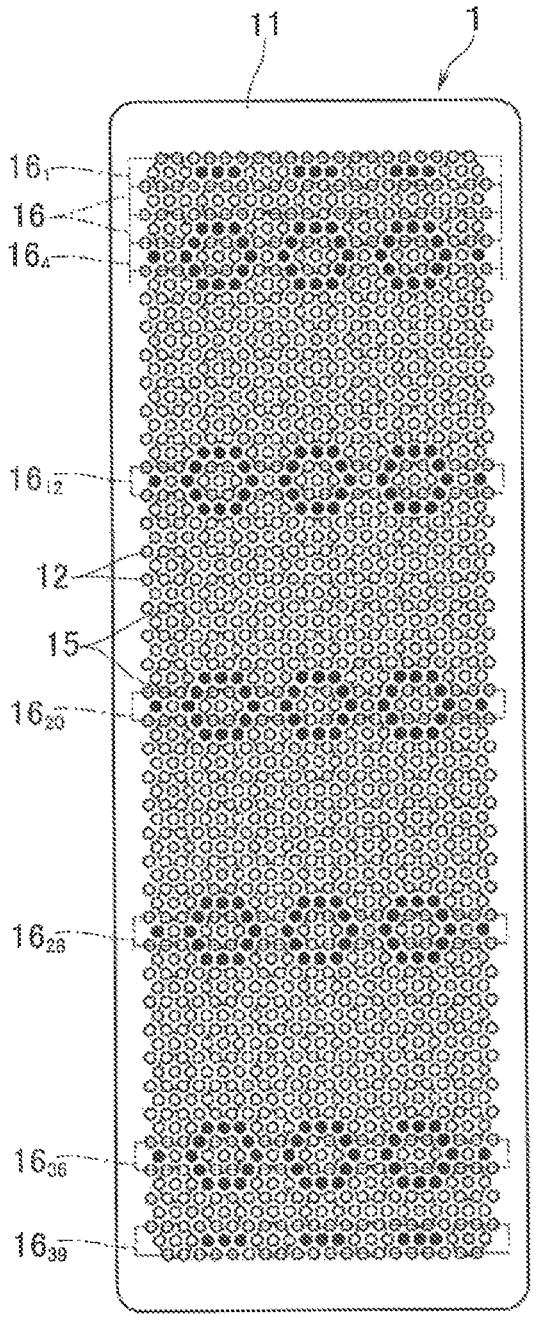
FIG. 7 is a plan view of a combustion plate according to a second embodiment of this invention.

Here, in the second embodiment as shown in FIG. 7, among the rows 16 of the unit flame hole groups, the fourth row $\mathbf{16}_4$, the twelfth row $\mathbf{16}_{12}$, the twentieth row $\mathbf{16}_{20}$, the twenty-eighth row $\mathbf{16}_{28}$, and the thirty-sixth row $\mathbf{16}_{36}$ are made to be the selected rows as counted from one end (upper end as seen in FIG. 7) in the longitudinal direction of the plate main body 11. Twelve flame holes 12 positioned on the large equilateral hexagon 14 that encloses each of the unit flame hole groups belonging to each of the selected rows are all closed. The opening ratio of the flame holes 12 in the second embodiment is 32%.

Figure 8:
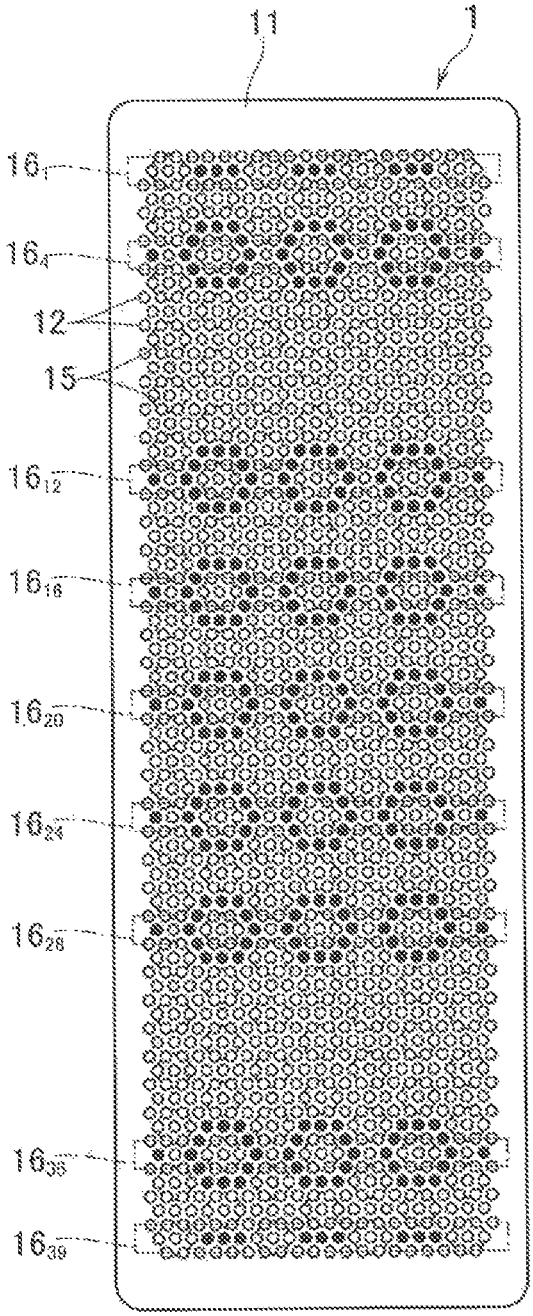
FIG. 8 is a plan view of a combustion plate according to a third embodiment of this invention.

In the third embodiment as shown in FIG. 8, as the selected row there were selected the sixteenth row $\mathbf{16}_{16}$, and the twenty-fourth row $\mathbf{16}_{24}$, in addition to the selected rows according to the second embodiment. All of the twelve flame holes 12 that are positioned on the large equilateral hexagon 14 enclosing each of the unit flame hole groups belonging to each of these selected rows are closed. The opening ratio of the flame holes 12 in the third embodiment is 30%.

Figure 9:
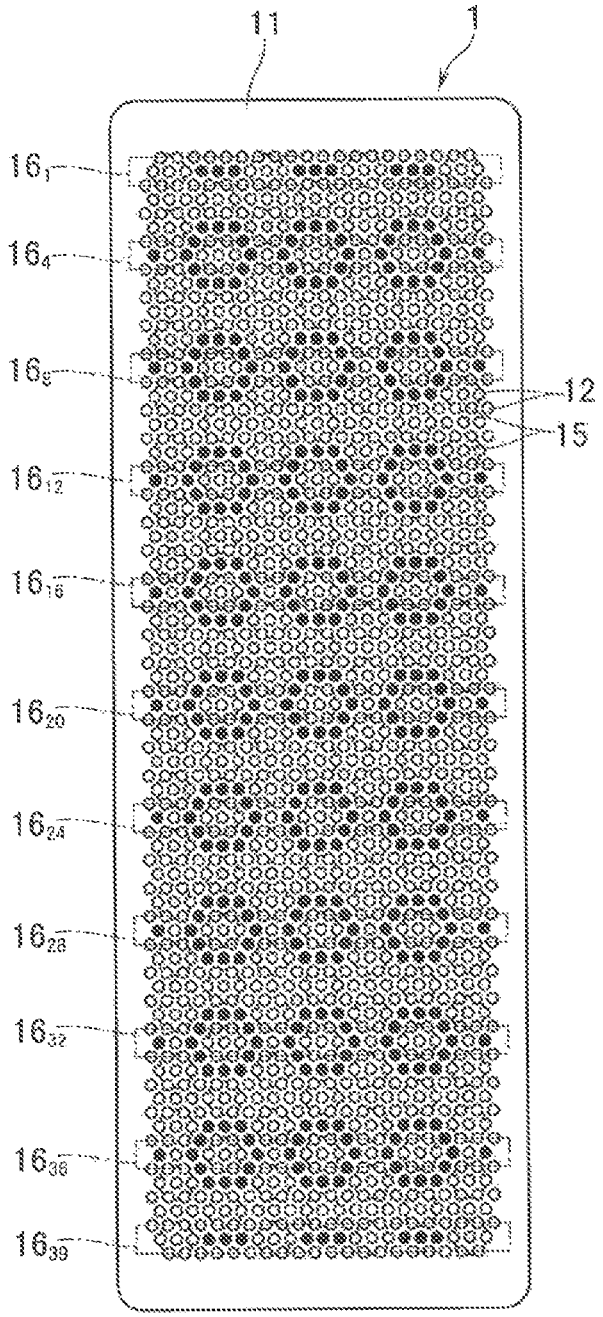
FIG. 9 is a plan view of a combustion plate according to a fourth embodiment of this invention.

In the fourth embodiment as shown in FIG. 9, selection was made, as the selected rows, of the eighth row $\mathbf{16}_8$ and the thirty second row $\mathbf{16}_{32}$, in addition to the selected rows according to the third embodiment so that three non-selected rows are present between each of the selected rows. All of the twelve flame holes 12 that are positioned on the large equilateral hexagon 14 enclosing each of the unit flame hole groups belonging to each of these selected rows are closed. The opening ratio of the flame holes 12 in the fourth embodiment is 28%. By the way, in the second embodiment-the fourth embodiment three flame holes 12 positioned between the centers of each of the unit flame hole groups belonging to each of the first and the thirty-ninth rows $\mathbf{16}_1$, $\mathbf{16}_{39}$ are also closed.

Figure 10:
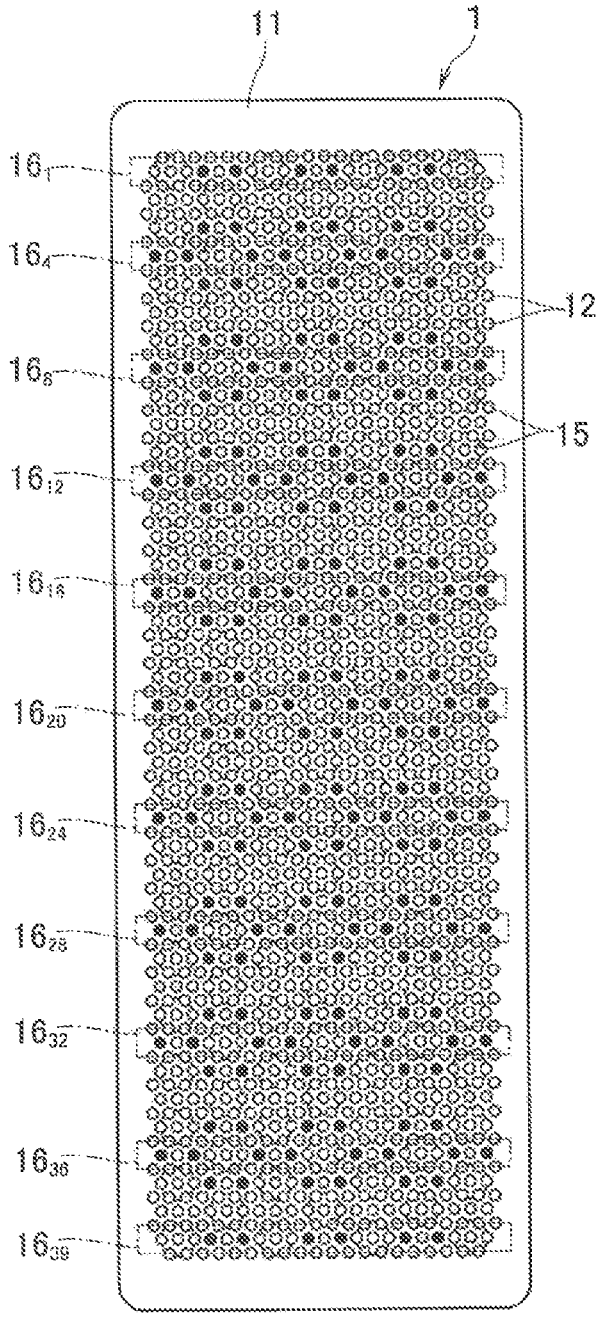
FIG. 10 is a plan view of a combustion plate according to a fifth embodiment of this invention.

In the fifth embodiment as shown in FIG. 10, as the selected rows the same rows as in the fourth embodiment were selected. But instead of all the flame holes 12 on the large equilateral hexagons 14 enclosing each of the unit flame hole groups belonging to each of these selected rows, a total of six flame holes 12 positioning in each of the corner portions of the equilateral hexagons 14 are closed. By the way, in the fifth embodiment out of the three flame holes 12 that are positioned between the centers of each of the unit flame hole groups belonging to each of the rows $\mathbf{16}_1$, $\mathbf{16}_{39}$, the two flame holes 12 that are near the respective unit flame hole groups are also closed. The opening ratio of the flame holes 12 in the fifth embodiment is 32%.

Figure 11:
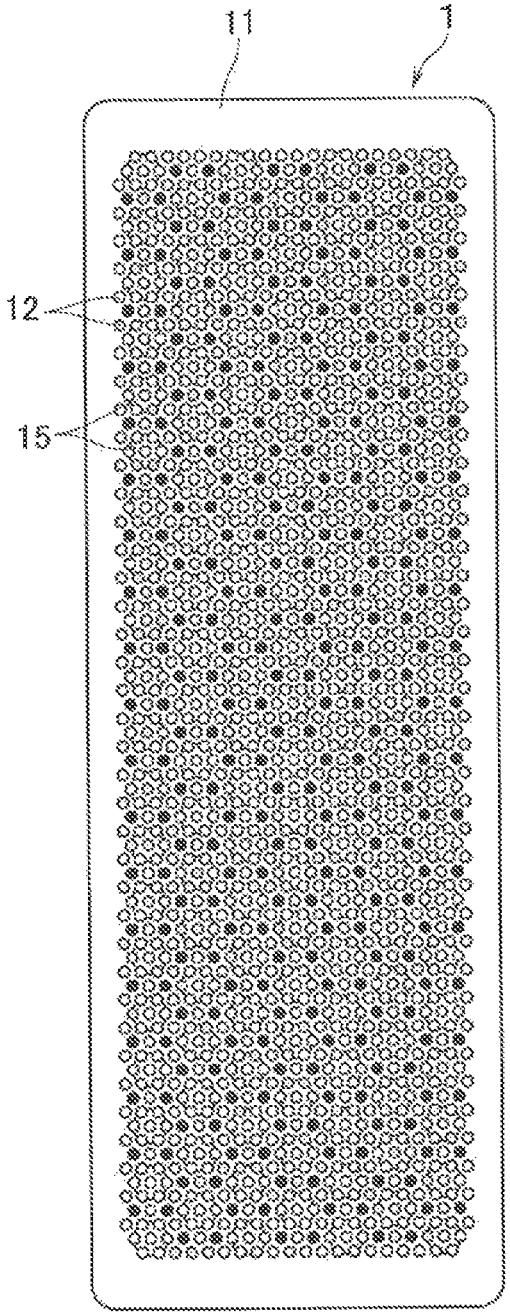
FIG. 11 is a plan view of a combustion plate according to a sixth embodiment of this invention.

In the sixth embodiment as shown in FIG. 11, the flame holes 12 that are positioned in each of the corner portions of the large equilateral hexagons 14 enclosing each of the respective unit flame hole groups are closed. The opening ratio of the flame holes 12 in the sixth embodiment is 30%.

Figure 12:
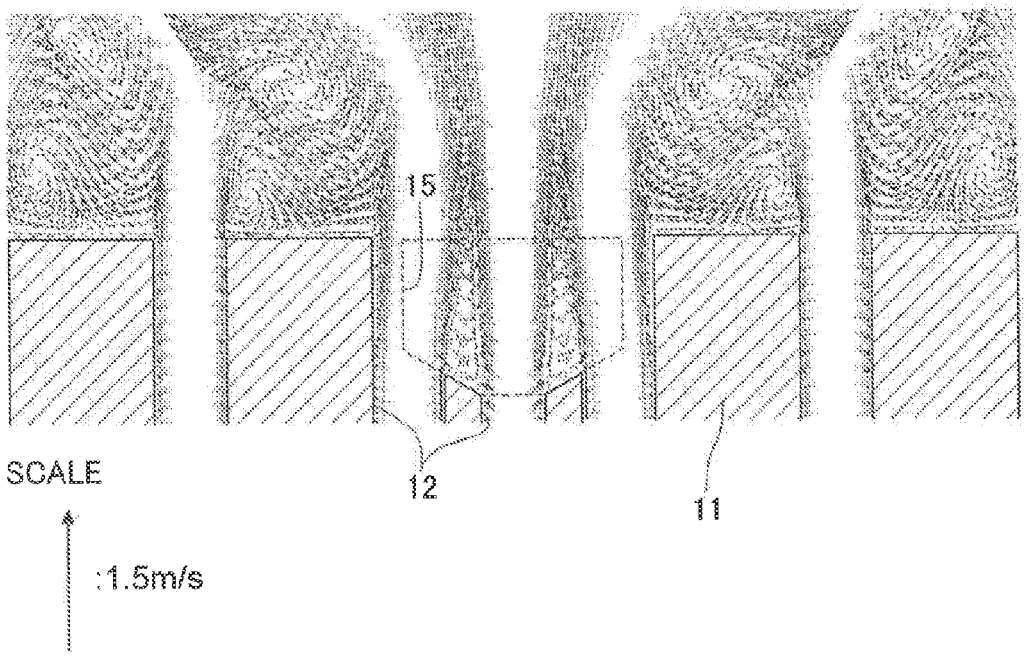
FIG. 12 is a diagram showing the velocity vectors of the premixed gas ejected from the combustion plate according to the second embodiment-the sixth embodiment of this invention.

If the flame holes 12 are closed as in the second embodiment-the sixth embodiment, there will be generated a recirculation region in which the premixed gas to be ejected from the bottomed holes 15 is partially recirculated in a manner to give rise to swirls in the flame hole closed portions, whereby an effect of maintaining a stable flame can be enhanced. Therefore, the combustion stability at the time of high-load combustion further improves. In order to confirm this effect, simulations were performed by using "FLUENT ver. 6" and studies were made of the velocity vectors of the premixed gas at the time of flowing the premixed gas to each of the flame holes 12 at a flow rate of $2.94\times10^{-6}$ $m^3$/sec. The results of the simulations are shown in FIG. 12 in which it can be seen that recirculation regions are formed above the flame hole closed portions.

In addition, combustion tests were carried out by using the combustion plates 1 of the first embodiment-the sixth embodiment. In these combustion tests the fuel gas was methane and the input (combustion amount) was 12 kW (2400 kW/$m^2$ when converted to calorific capacity for flame hole area). By varying the excess air ratios of the premixed gas, COaf which is the CO concentration in the theoretical dry combustion gas was measured. By the way, an arrangement was made in the tests such that the premixed gas of uniform excess air ratio was supplied to an entire region of the combustion plate 1. In the actual burners, however, due to lack of mixing between the fuel gas and the primary air, fluctuations occurred in the excess air ratio in the premixed gas at each part of the combustion plate 1. And due to the delay in response to the number of rotation of the fan relative to the change in input, there will be cases where the excess air ratio sometimes deviates from a required target value during combustion. It is therefore preferable to make the range of the excess air ratio to perform good combustion as wide as possible.

Figure 13:
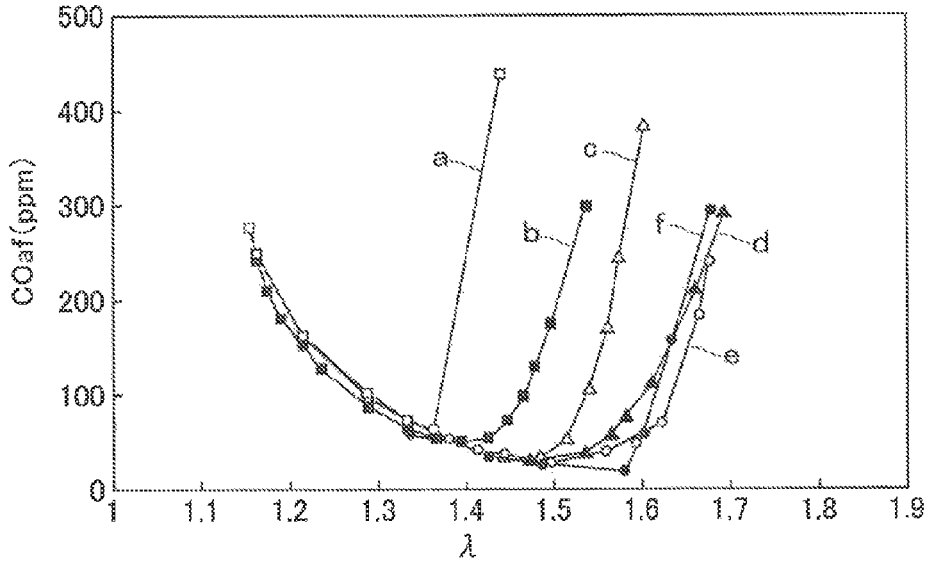
FIG. 13 is a graph showing the results of combustion tests performed using the combustion plate according to the first embodiment-the sixth embodiment of this invention.

FIG. 13 shows the results of the combustion tests, in which line "a" is of the first embodiment, line b is of the second embodiment, line c is of the third embodiment, line d is of the fourth embodiment, line e is of the fifth embodiment, and line f is of the sixth embodiment. The lower limit of the range of excess air ratio $\lambda$ in which good combustion takes place in COaf<400 ppm has been found to be about 1.12 in any of the first embodiment-the sixth embodiment, while the upper limits thereof have been found to be 1.42 in the first embodiment, 1.55 in the second embodiment, 1.60 in the third embodiment, 1.71 in the fourth embodiment, and 1.69 in the fifth embodiment and the sixth embodiment.

In addition, combustion tests were carried out by using a combustion plate without providing the bottomed holes 15 and flame hole closing portions. In this case the flames were aggregated and integrated with an increase in the input so as to become instable liftoff flames without the presence of stabilized flame portion at all. Combustion up to 9 kW was the limit and the combustion up to 12 kW was impossible. On the other hand, in the first embodiment having bottomed holes 15 formed therein, good combustion was possible even at 12 kW. From the above it can be seen that, due to the bottomed holes 15, there was obtained an effect of maintaining a stable flame in which the flame was prevented from being lifted off at the time of the above-mentioned high-load combustion.

Further, when the number of the selected rows was increased as in the second embodiment-the fourth embodiment, the flames come to be hardly lifted off, and the upper limit of the range of excess air ratio to perform good combustion becomes larger. From the above, it can be seen that recirculation region is generated by the flame hole closed portions, thereby enhancing the flame stabilizing effect. In addition, in the fifth embodiment in which, out of the twelve flame holes 12 on the large equilateral hexagon 14 enclosing each of the unit flame hole groups belonging to the selected row, closure was made only of six flame holes 12 that are positioned in the corner portions of the equilateral hexagon. Then, despite the fact that the number of the selected rows is the same as that of the fourth embodiment, the upper limit of the range in the excess air ratio to perform good combustion becomes substantially the same as that of the fourth embodiment. From the above fact, it can be seen that, in order to enhance the effect of maintaining a stable flame and also in order to increase the opening ratio of the flame holes 12, the flame holes 12 that are positioned in each of the corner portions of the above-mentioned large equilateral hexagon need be closed. Further, although the opening ratio is the same (32%) in the second embodiment and in the fifth embodiment, the range of excess air ratio in which good combustion can be performed is wider and superior in the fifth embodiment (line e in FIG. 13) than in the second embodiment (line b in FIG. 13).

However, as in the sixth embodiment, if closure was made of the flame holes 12 that are positioned in each of the corner portions of all the large equilateral hexagons 14 that enclose all of the unit flame hole groups, high-frequency combustion resonant sounds occurred within the range below 1.3 in the excess air ratio. This is because resonance occurs among the aggregated flames of each of the unit flame hole groups in the entire region of the combustion plate 1.

Here, suppose that the diagonal direction of the equilateral hexagon 13 formed by six flame holes 12 of the unit flame hole group is defined as a row direction. Then in case closure is made of the flame holes 12 positioned in each of the corner portions of all the large equilateral hexagons 14 enclosing each of the unit flame hole groups belonging to the selected row, the result will be substantially the same as that of the sixth embodiment if the number of non-selected rows that are present between each of the selected rows is below two. Therefore, in order to prevent the occurrence of combustion resonant sounds, it is necessary to make the number of the non-selected rows present between each of the selected rows to be more than three as is the case in the second embodiment-the fifth embodiment.

Figure 14:
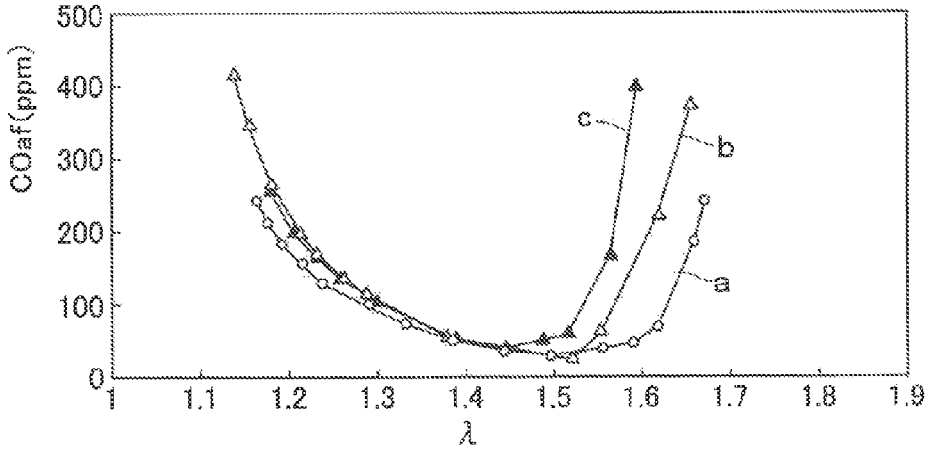
FIG. 14 is a graph showing the results of combustion tests performed using the combustion plate according to the fifth embodiment of this invention and the conventional combustion plate.

Further, by using the combustion plate 1 of the fifth embodiment, combustion tests were carried out with inputs of 12 kW and 13.8 kW respectively, and the results as shown in FIG. 14 were obtained. In FIG. 14 line "a" shows the results at the input of 12 kW, and line b shows the results at the input of 13.8 kW. In addition, the line c in FIG. 14 shows the results of combustion tests performed by using the combustion plate described in Patent Document 1 as an example, and at the input of 12 kW. In the fifth embodiment the range of excess air ratio $\lambda$ in which good combustion was performed at COaf<400 ppm is found to be as narrow as 1.14-1.66 at the time of combustion of 13.8 kW as compared with 1.12-1.69 at the time of combustion of 12 kW, but is yet wider than 12 kW at the time of combustion of 12 kW in the example of the Patent Document 1. Further, while the flame opening ratio of the example in Patent Document 1 is 26%, the flame opening ratio of the fifth embodiment is as large as 32%, and the load on the fan is reduced with the reduction in the fan noises.

Figure 15:
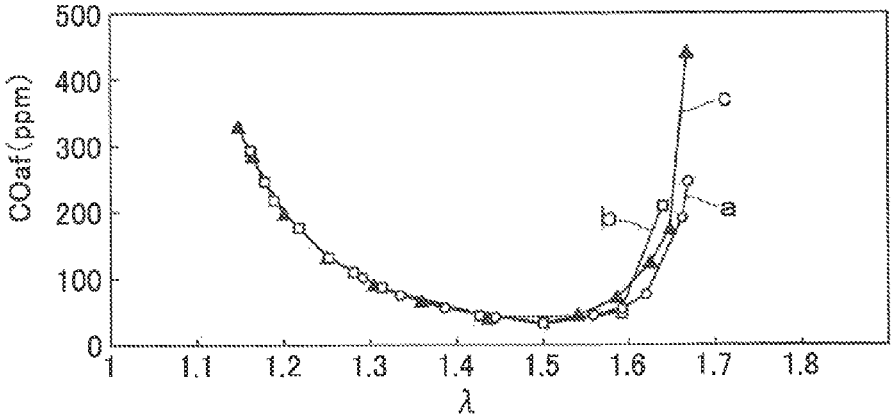
FIG. 15 is a graph showing the results of combustion tests performed using the combustion plate according to the fifth embodiment of this invention and the combustion plate according to modified embodiments of this invention in which the depths and diameters of the bottomed holes were changed.

Still furthermore, by using: the combustion plate 1 of the fifth embodiment; the combustion plate of the first modified example in which the depth h of the bottomed hole 15 was changed from 2 mm of the fifth embodiment to 1 mm with the others being the same as those of the fifth embodiment; and the combustion plate of the second modified example in which the diameter of the bottomed hole 15 was changed from 4 mm of the fifth embodiment to 3.2 mm and the depth h was made to be 1 mm in both cases, with the others being the same as those in the fifth embodiment, combustion tests were carried out with the input of 12 kW, the results as shown in FIG. 15 have been obtained. In FIG. 15 line "a" is of the fifth embodiment, line b is of the first modified example, and line c is of the second modified example. From these results it can be seen that substantially the same degree of effect of maintaining a stable flame can be obtained even though the depth h of the bottomed hole 15 was made to be 1 mm, and the diameter of the bottomed hole 15 was further made to be 3.2 mm.

Figure 16:
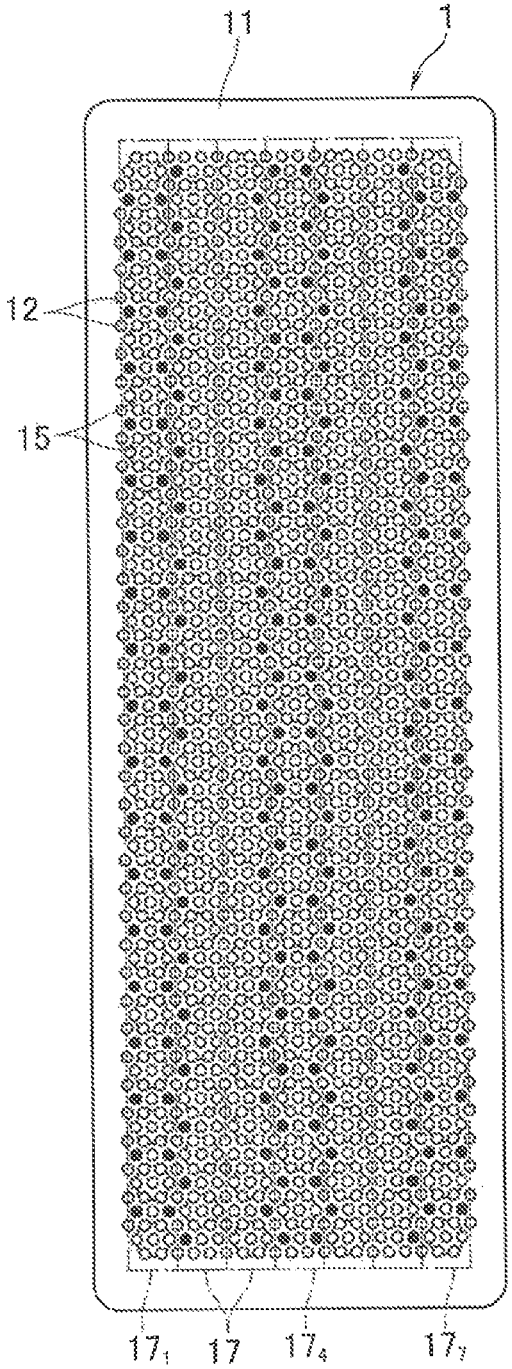
FIG. 16 is a plan view of a combustion plate according to a seventh embodiment of this invention.

Description will now be made of the seventh embodiment as shown in FIG. 16. In this seventh embodiment suppose that the opposing direction (longitudinal direction of the plate main body 11) of the upper and lower opposite sides, as seen in the figure, of the equilateral hexagon 13 to be formed by the six flame holes of the unit flame hole group is defined as the row direction. Then, a plurality of rows at a predetermined distance from one another in a direction perpendicular to the row direction (direction of short sides of the plate main body 11) are selected, and closure is made of the flame holes 12 that are positioned in each of the corner portions of the large equilateral hexagon 14 enclosing each of the unit flame hole groups belonging to these selected rows. The arrangement in the seventh embodiment can obtain the effect of maintaining a stable flame of substantially the same degree as that in the fifth embodiment.

Suppose that the opposing direction of the opposite sides of the equilateral hexagon 13 to be formed by the six flame holes of the unit flame hole groups is defined as the row direction. Then, in case closure is made of the flame holes 12 positioned in each of the corner portions of all the large equilateral hexagons 14 enclosing each of the unit flame hole groups belonging to the selected rows, if the number of the non-selected rows that are present between each of the selected rows is only one, the state will be substantially the same as that of the sixth embodiment, resulting in the generation of combustion resonant sounds. As a solution, in the seventh embodiment an arrangement has been made that selection is made of the first row $\mathbf{17}_1$, the fourth row $\mathbf{17}_4$, and the seventh row $\mathbf{17}_7$ as the selected rows as counted from one end of the short-side direction of the plate main body 11 (left end as seen in FIG. 16) so that two non-selected rows are present between each of the selected rows.

Description has so far been made of the embodiments of this invention with reference to the figures. This invention is however not limited to the above. For example, in the above-mentioned second embodiment-the fifth embodiment, the short-side direction of the plate main body 11, that is one of the diagonal directions of the equilateral hexagon 13 to be formed by the six flame holes of the unit flame hole group, has been defined as the row direction. Alternatively, definition may be made such that the direction inclined by 60 degrees relative to the short-side direction of the plate main body 11, i.e., the other diagonal direction of the equilateral hexagon 13, may be defined as the row direction. Out of the unit flame hole groups arrayed in this row direction, the selected row is selected at a predetermined distance (such a distance that at least three non-selected rows are present between each of the selected rows) in a direction perpendicular to the row direction. And closure may be made of at least part of the twelve flame holes that are positioned on the large equilateral hexagon enclosing each of the unit flame hole groups belonging to the selected row.

In addition, in the above-mentioned seventh embodiment, definition was made such that the longitudinal direction, which is one of the opposing directions of the opposite sides of the equilateral hexagon 13 to be formed by the six flame holes of the unit flame hole group, of the plate main body 11 is the row direction. Alternatively, the direction inclined by 30 degrees relative to the short-side direction, that is the opposing direction of the other opposite sides of the equilateral hexagon 13 of the plate main body 11, may be defined as the row direction. Then, selection may be made of the selected rows at a predetermined distance (at such a distance that at least two non-selected rows are present between each of the selected rows) perpendicular to the row direction out of the rows of the unit flame hole groups arrayed in this row direction. At least partial closure may thus be made of the flame holes that are positioned on the large equilateral hexagon enclosing each of the unit flame hole groups belonging to the selected rows.

Further, in the above-mentioned embodiments, this invention was applied to the combustion plate 1 adapted to be used in a totally aerated combustion burner which is disposed in a heat source apparatus for supplying hot water or for heating space. The uses to which the burner of this invention is applied are not limited to the heat source apparatus, but this invention can be widely applied as a combustion plate for a totally aerated combustion burner in which combustion at a high load takes place.

EXPLANATION OF REFERENCE MARKS

1 combustion plate
11 plate main body
12 flame hole
13 equilateral hexagon formed by six flame holes of unit flame hole group
14 large equilateral hexagon enclosing unit flame hole group
5 bottomed hole
15*a* tapered surface
16 row of unit flame hole group arrayed in diagonal direction of equilateral hexagon to be formed by six flame holes of the unit flame hole group
17 row of unit flame hole group arrayed in opposing direction of opposite sides of equilateral hexagon to be formed by six flame holes of the unit flame hole group

What is claimed is:

1. A combustion plate for a totally aerated combustion burner in which a multiplicity of flame holes for ejecting a premixed gas are formed in a plate main body of ceramic make, wherein the flame holes of an equal diameter are evenly formed over an entire surface of a combustion region of the plate main body in such a positional relationship that adjoining three flame holes form an equilateral triangle, and wherein, provided that a flame hole group which is made up of six flame holes disposed in a positional relationship to form an equilateral hexagon and one flame hole in a center thereof is defined as a unit flame hole group when disposed adjacent to another flame hole group across a large equilateral hexagon which is made up of a flame hole at each of the corner portions and a flame hole in a middle of each of the sides of the large equilateral hexagon, a bottomed hole is formed in the surface of the plate main body in a manner:

to be coaxial with the flame hole in the center of each of the unit flame hole groups;

to be smaller than a diameter of a circle circumscribing the six flame holes that are in such a positional relationship as to form the equilateral hexagon; and to be larger than a diameter of a circle inscribing the six flame holes, whereby the premixed gas ejected from the six flame holes has a velocity component toward a center of the bottomed hole, wherein each of the six flame holes which make up the flame hole group is located next to one of the twelve flame holes and next to the flame hole in the center, wherein the six flame holes are open for ejecting a premixed gas;

wherein, provided that a predetermined diagonal direction of, or an opposing direction of predetermined opposite sides of, the equilateral hexagon to be constituted by six flame holes in the unit flame hole group is defined as a row direction, at least a plurality of such flame holes out of twelve flame holes which are located away from the bottomed hole are closed to prevent ejecting the premixed gas as are positioned on the large equilateral hexagon that encloses each of the unit flame hole groups belonging to a selected row, the selected row being selected at a predetermined distance in a direction perpendicular to the row direction out of the unit flame hole groups arrayed in the row direction, and wherein the predetermined distance is set such that, where the row direction is the diagonal direction, at least three non-selected rows are present between each of the selected rows and that, where the row direction is the opposing direction of the opposite sides, at least two non-selected rows are present between each of the selected rows.

2. The combustion plate according to claim 1, wherein a bottom surface of the bottomed hole is formed so as to become deeper toward a center thereof.

3. The combustion plate according to claim 1, wherein the bottomed hole is formed so as to become smaller in diameter toward the bottom surface thereof.

4. The combustion plate according to claim 1, wherein the depth of the lowermost portion in the periphery of the bottomed hole is above 1 mm and below 3 mm.

5. The combustion plate according to claim 1, wherein the flame holes to be subjected to closure are the flame holes positioned at each of the corner portions of the large equilateral hexagon.

6. The combustion plate according to claim 1, wherein there is formed a circulating flow region at which the premixed gas is partially swirled so as to return to a flame hole closed portion.

* * * * *